US012055088B2

(12) United States Patent
Yamazaki et al.

(10) Patent No.: US 12,055,088 B2
(45) Date of Patent: Aug. 6, 2024

(54) INTERNAL COMBUSTION ENGINE

(71) Applicant: HONDA MOTOR CO., LTD., Tokyo (JP)

(72) Inventors: Wataru Yamazaki, Wako (JP); Yasunori Matsubara, Wako (JP); Takashi Suzuki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/694,390

(22) Filed: Mar. 14, 2022

(65) Prior Publication Data

US 2022/0298956 A1 Sep. 22, 2022

(30) Foreign Application Priority Data

Mar. 17, 2021 (JP) ..... 2021-043894

(51) Int. Cl.
*F01P 5/06* (2006.01)
*F01P 1/02* (2006.01)

(52) U.S. Cl.
CPC ..... *F01P 5/06* (2013.01); *F01P 1/02* (2013.01); *F01P 2001/023* (2013.01)

(58) Field of Classification Search
CPC ..... F01P 5/06; F01P 1/02
See application file for complete search history.

(56) References Cited

U.S. PATENT DOCUMENTS 5,070,686 A 12/1991 Isaka et al.
2005/0039355 A1 2/2005 Itou et al.
2008/0039355 A1* 2/2008 Katano ..... G03F 7/168 510/407
2008/0184682 A1* 8/2008 Nelson ..... B01D 46/10 55/385.3
2009/0293835 A1* 12/2009 Nakamizo ..... F02M 35/022 55/282
2013/0291810 A1* 11/2013 Nishikawa ..... F02B 63/02 123/2
2014/0261259 A1 9/2014 Sullivan et al.
2016/0115933 A1* 4/2016 Koenen ..... H01M 10/02 290/38 R
2016/0281587 A1 9/2016 Arbel
2017/0045015 A1* 2/2017 Nishi ..... F01P 5/06
2019/0060813 A1* 2/2019 Yano ..... B01D 46/0002
(Continued)

FOREIGN PATENT DOCUMENTS

CN 206376933 U 8/2017
JP S63-209509 A 8/1988
(Continued)

OTHER PUBLICATIONS

Chinese Office Action dated Jan. 26, 2024 issued in corresponding Chinese application No. 202210230460.8; English machine translation included (11 pages).
(Continued)

*Primary Examiner* — Long T Tran
(74) *Attorney, Agent, or Firm* — Rankin, Hill & Clark LLP

(57) ABSTRACT

The internal combustion engine includes a fan cover that covers a cooling fan driven by a crankshaft, a top cover that covers the fan cover, and a cooling air passage between the fan cover and the top cover. The fan cover includes a first rib facing the top cover in the cooling air passage.

8 Claims, 8 Drawing Sheets

(56) References Cited

U.S. PATENT DOCUMENTS

| | | | | |
|---|---|---|---|---|
| 2020/0232379 | A1 | 7/2020 | Zuehl et al. | |
| 2021/0017933 | A1* | 1/2021 | Kobayashi | F02B 75/22 |

FOREIGN PATENT DOCUMENTS

| | | | |
|---|---|---|---|
| JP | 2005-67320 | A | 3/2005 |
| JP | 2005-120974 | A | 5/2005 |
| JP | 2011-177094 | A | 9/2011 |
| JP | 6200074 | | 9/2017 |
| WO | 2019/187113 | A1 | 10/2019 |

OTHER PUBLICATIONS

Japanese Office Action dated May 7, 2024 issued in corresponding Japanese application No. 2021-043894 (3 pages).
German Office Action dated Mar. 20, 2024 issued in corresponding German application No. 10 2022 105 173.0; English translation included (10 pages).

* cited by examiner

INTERNAL COMBUSTION ENGINE

INCORPORATION BY REFERENCE

The present application claims priority under 35 U.S.C. § 119 to Japanese Patent Application No. 2021-043894 filed on Mar. 17, 2021. The content of the application is incorporated herein by reference in its entirety.

BACKGROUND OF THE INVENTION

Field of the Invention

The present invention relates to an internal combustion engine.

Description of the Related Art

Conventionally, an internal combustion engine used for, for example, a lawn mower has been known.

A technique is conventionally disclosed on an internal combustion engine, which is to be used for such a lawn mower, including: a first cover that covers an outer side of a cylinder, an outer side of a crankcase, and a cooling fan; a second cover attachable to and detachable from the first cover, wherein: the first cover includes a first opening provided at a position facing the cooling fan, a second opening, and a wall erected between the first opening and the second opening; the second cover includes an air inlet provided at a position facing the first opening; and the second cover is attached to the first cover to cover the first opening and the second opening and to define an outlet for the cooling air adjacent to the wall between the first cover and the second cover (see, for example, Japanese Patent No. 6200074).

However, in the technique described in Japanese Patent No. 6200074, the wall can prevent foreign matter such as turf and grass from entering the second opening from the air inlet, but cannot prevent grass and the like from entering through a gap in the covers.

The present invention has been made in view of the above points, and an object of the present invention is to provide an internal combustion engine capable of preventing dust and the like from entering from a cooling air intake portion with a simple configuration.

SUMMARY OF THE INVENTION

In order to achieve the above object, an aspect of the present invention is an internal combustion engine including: a fan cover that covers a cooling fan driven by a crankshaft; a top cover that covers the fan cover; and a cooling air passage between the fan cover and the top cover, wherein the fan cover includes a first rib facing the top cover in the cooling air passage.

According to the aspect of the present invention, when the cooling air is taken into the fan cover from the top cover, the intake amount of the cooling air can be sufficiently maintained, and dust and the like can be prevented from entering by the first rib.

DETAILED DESCRIPTION OF THE PREFERRED EMBODIMENT

The following describes an embodiment with reference to the drawings.

Embodiment

Figure 1:
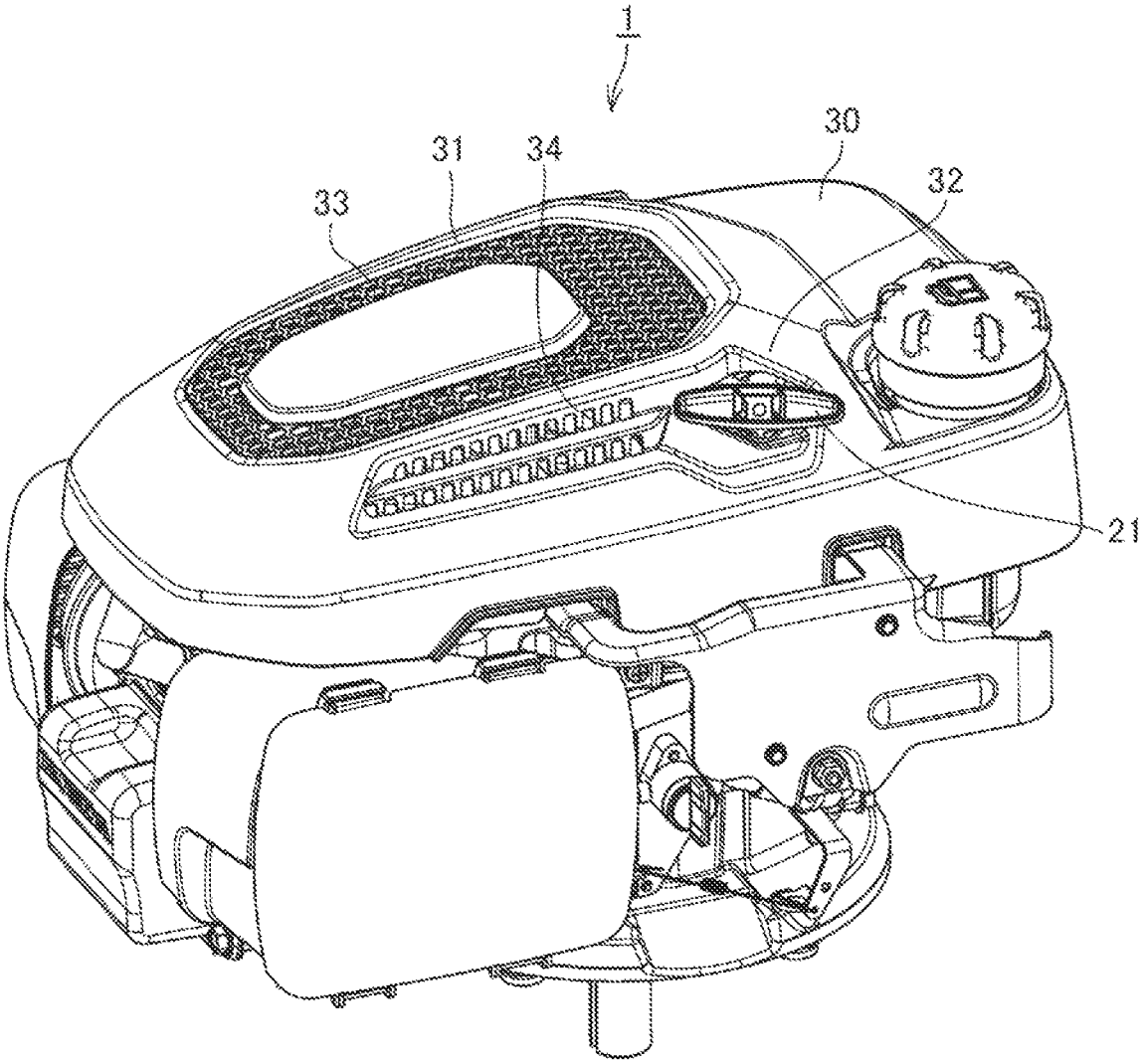
FIG. 1 is a perspective view showing a configuration of an internal combustion engine according to this embodiment.
Figure 2:
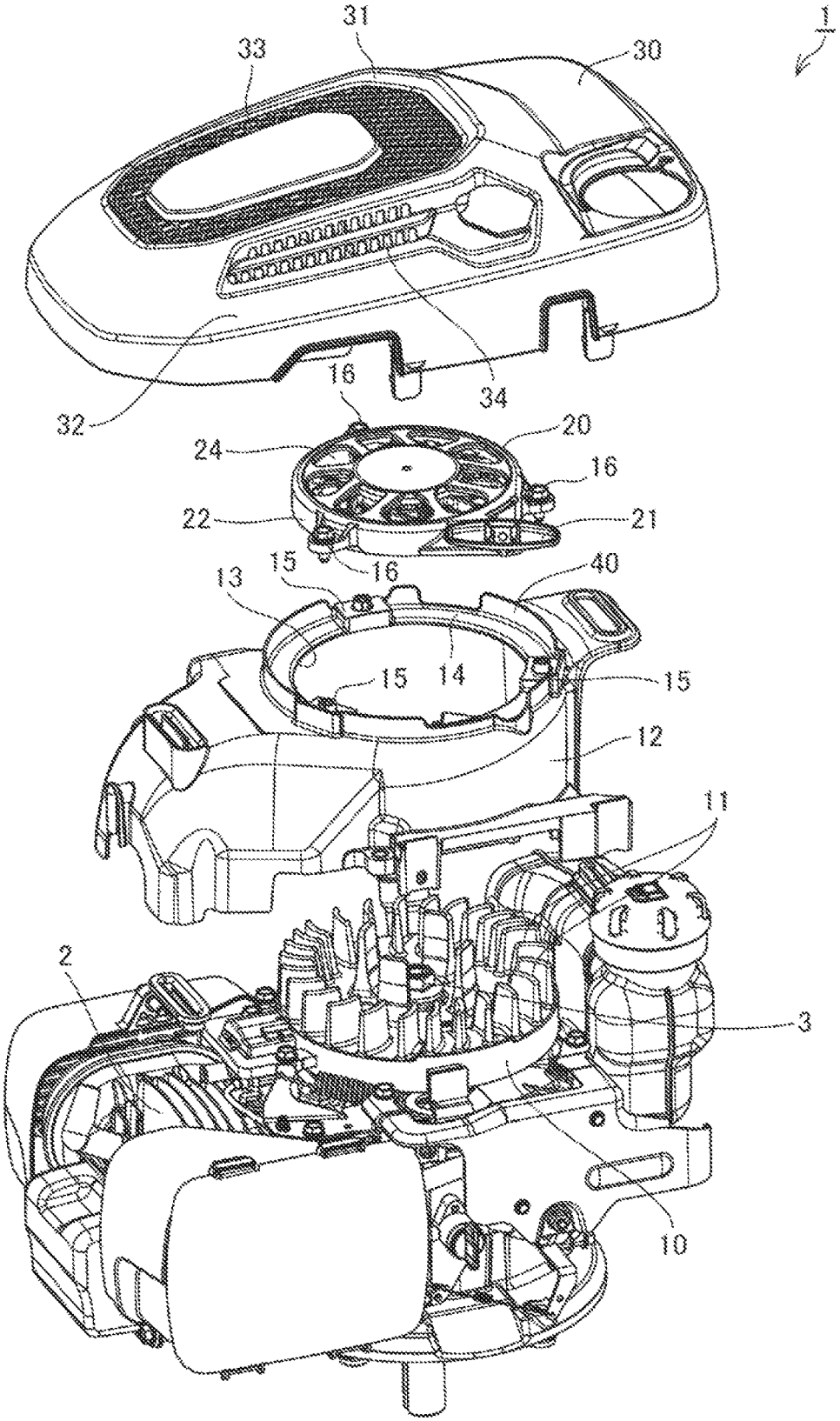
FIG. 2 is an exploded perspective view of the internal combustion engine of this embodiment.
Figure 3:
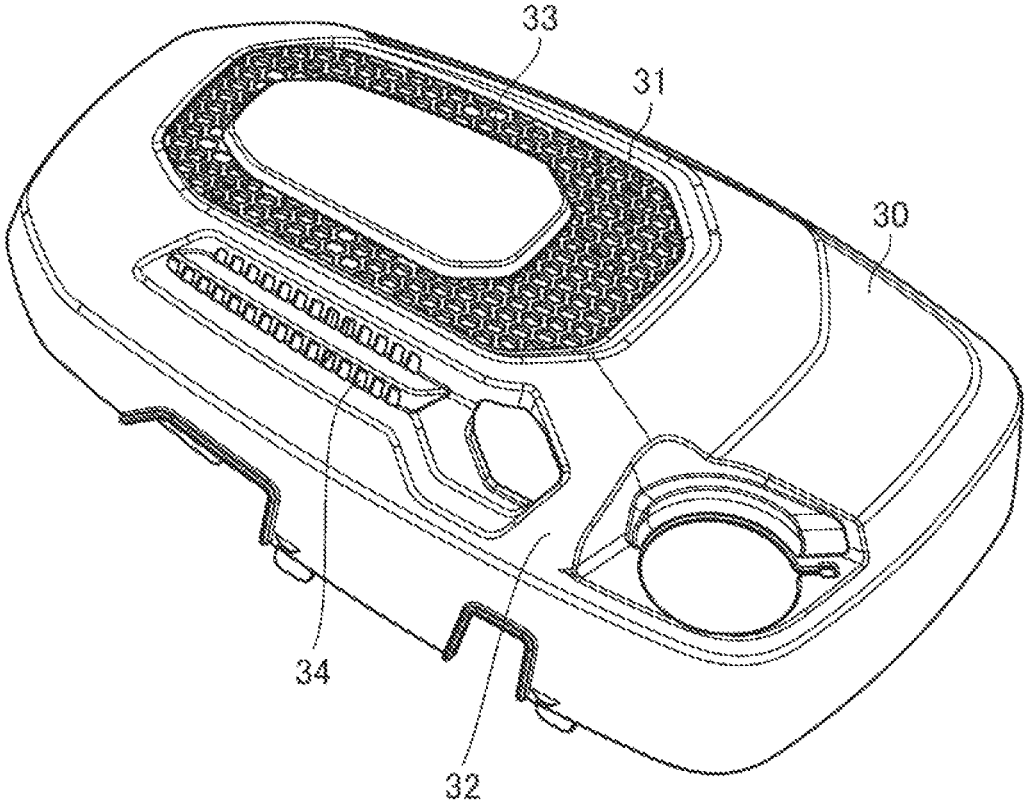
FIG. 3 is a perspective view showing a top cover of this embodiment.
Figure 4:
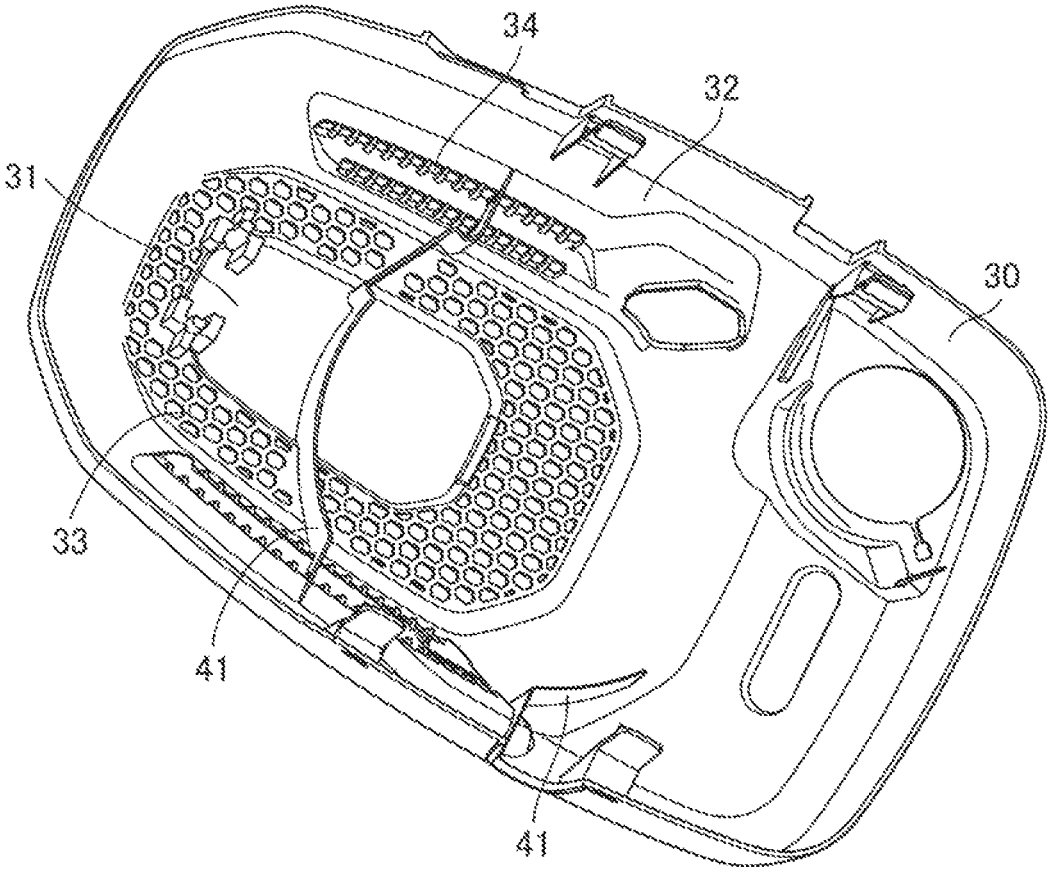
FIG. 4 is a perspective view showing a back surface side of the top cover of this embodiment.
Figure 5:
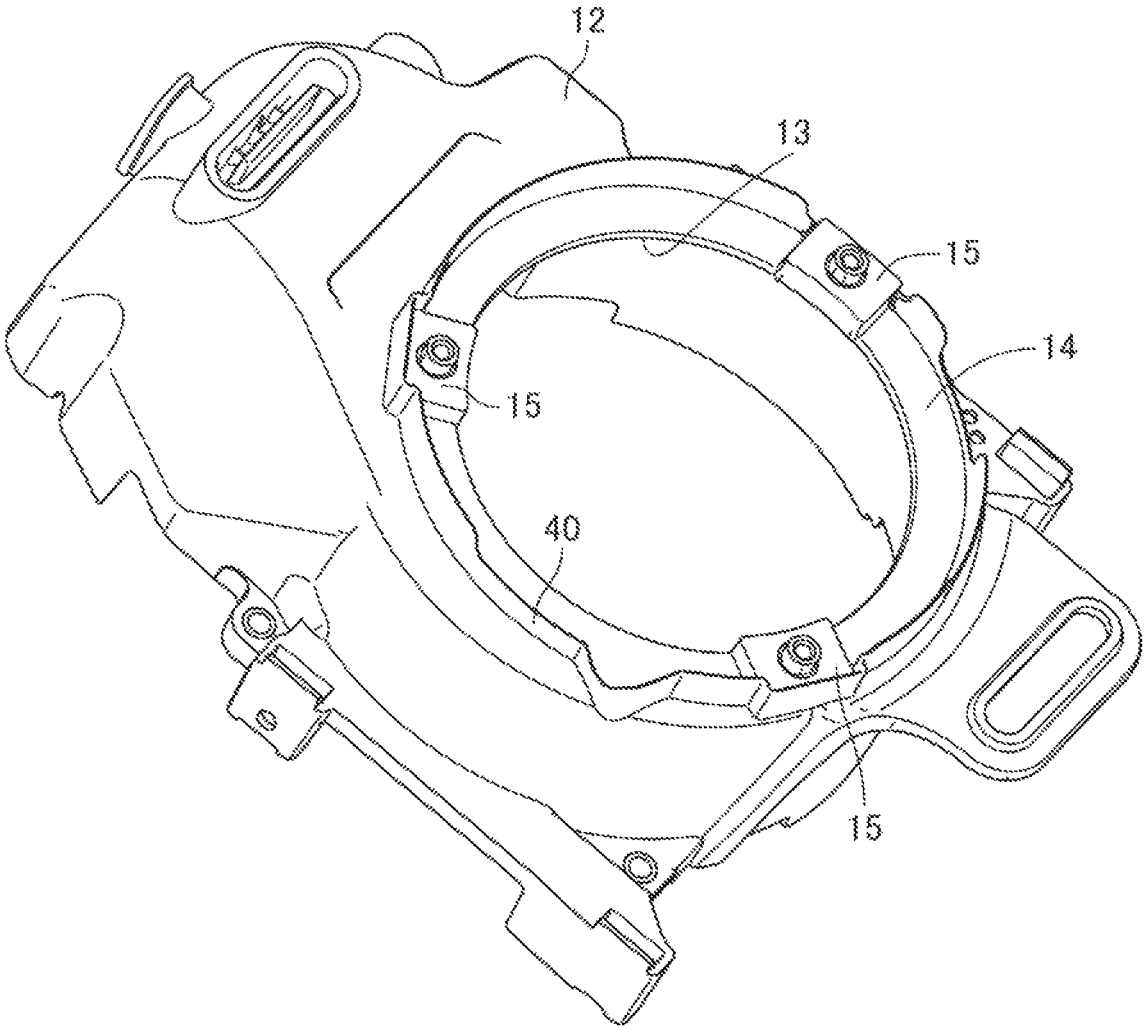
FIG. 5 is a perspective view showing a fan cover of this embodiment.
Figure 6:
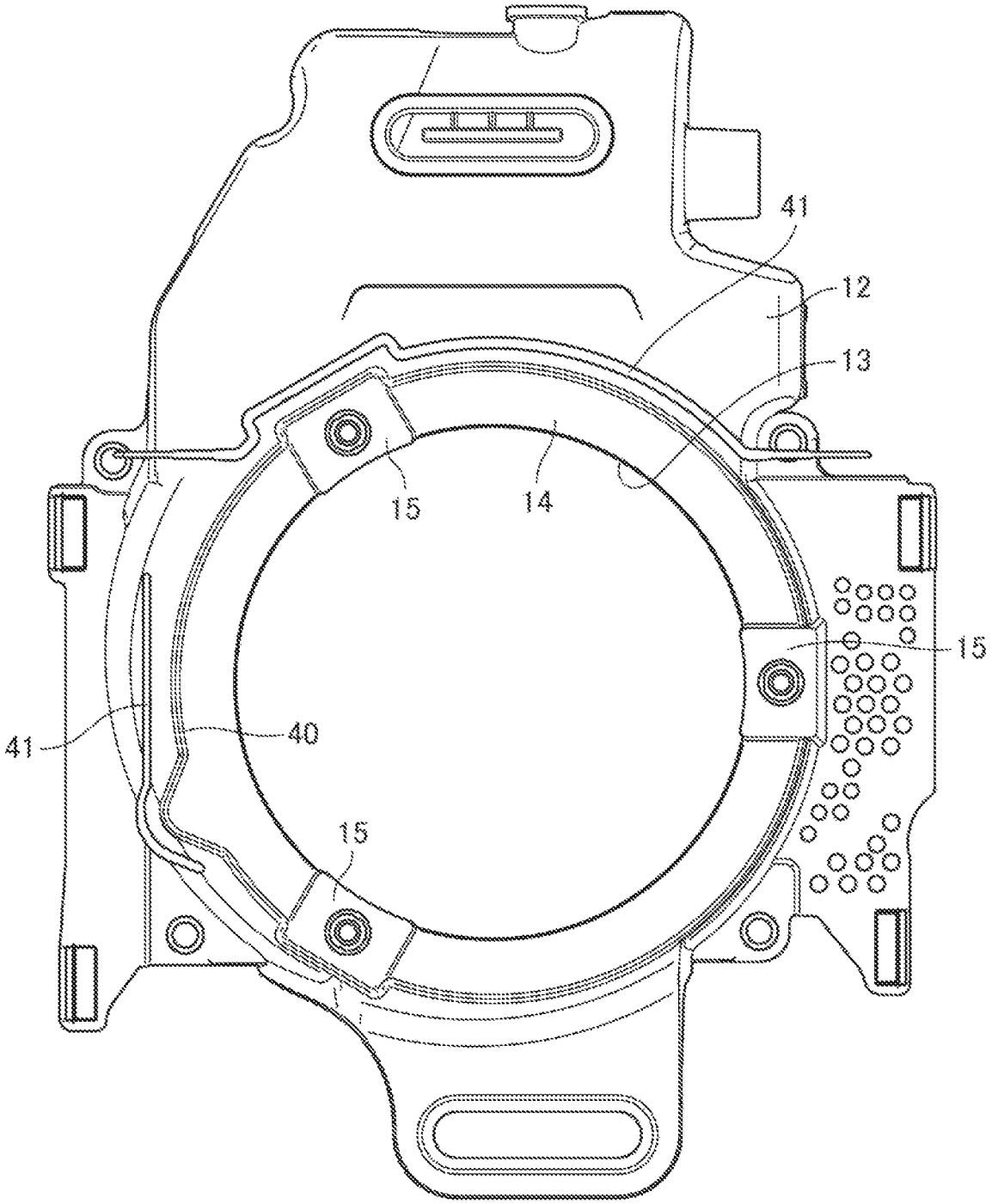
FIG. 6 is a plan view showing the fan cover of this embodiment.
Figure 7:
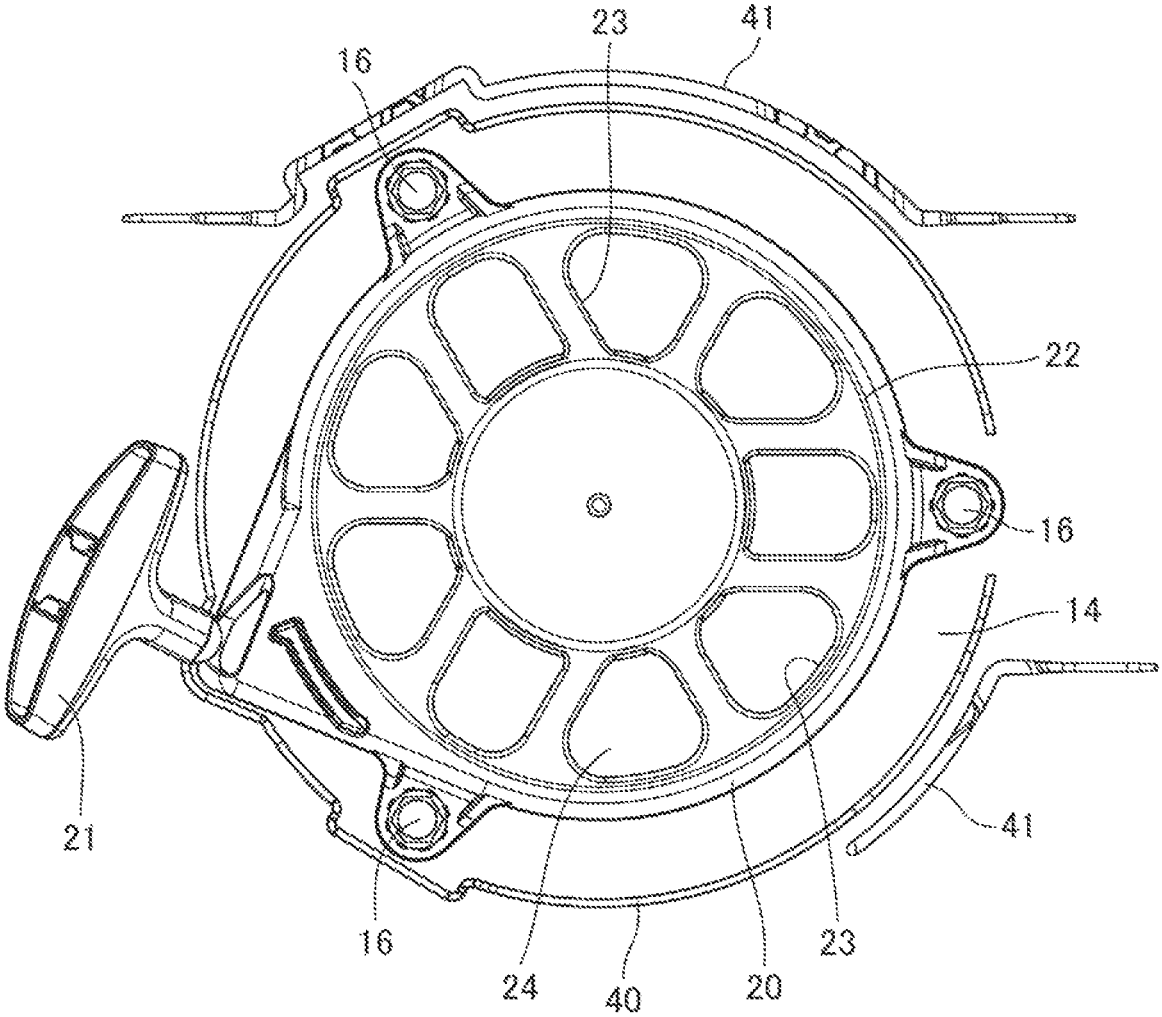
FIG. 7 is a plan view showing the fan cover to which a recoil of this embodiment is mounted.
Figure 8:
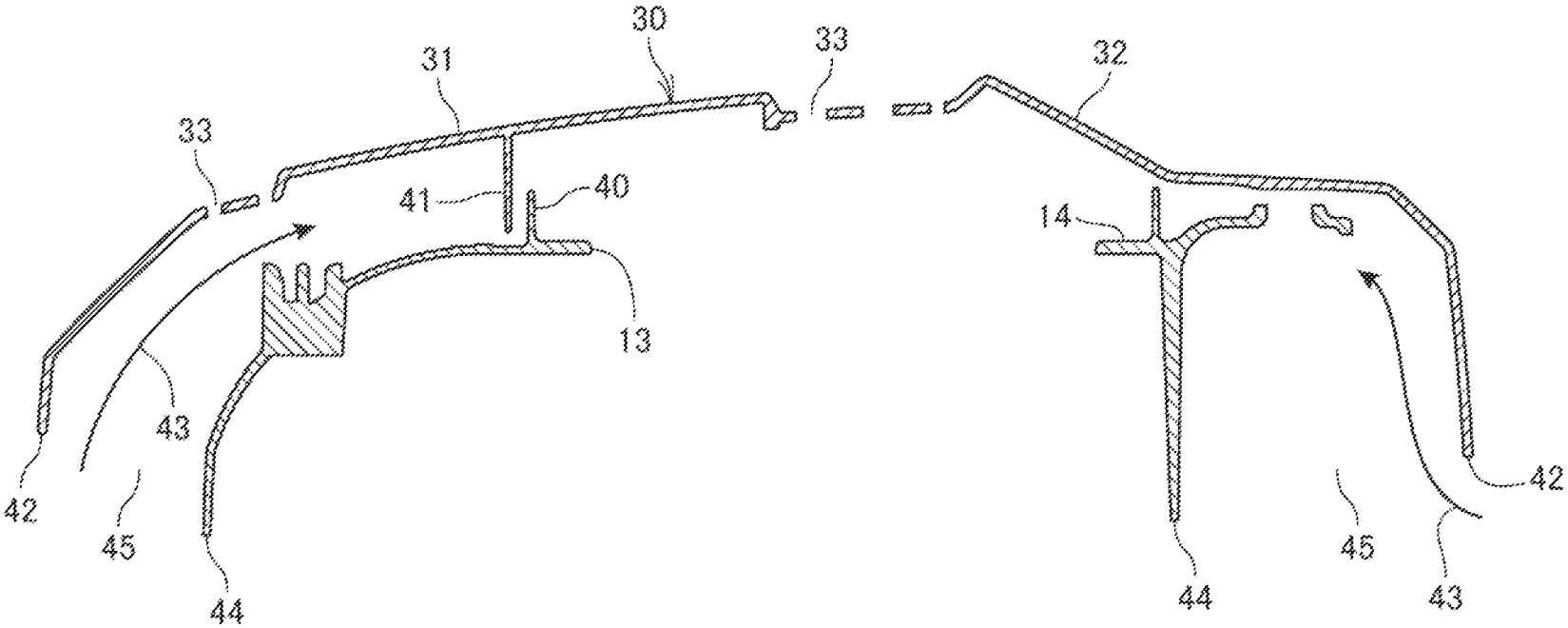
FIG. 8 is a longitudinal cross-sectional view of the top cover and the fan cover portion of this embodiment.

FIG. 1 is a perspective view showing a configuration of an internal combustion engine according to this embodiment. FIG. 2 is an exploded perspective view of the internal combustion engine of this embodiment. FIG. 3 is a perspective view showing a top cover of this embodiment. FIG. 4 is a perspective view showing a back surface side of the top cover of this embodiment. FIG. 5 is a perspective view showing a fan cover of this embodiment. FIG. 6 is a plan view showing the fan cover of this embodiment. FIG. 7 is a plan view showing the fan cover to which a recoil of this embodiment is mounted. FIG. 8 is a longitudinal cross-sectional view of the top cover and the fan cover portions of this embodiment.

As shown in FIGS. 1 and 2, in this embodiment, the internal combustion engine 1 includes a cylinder head 2.

A cylinder (not shown) is provided so as to extend substantially in the horizontal direction. A crankshaft 3 connected to a piston (not shown) that reciprocates inside the cylinder is provided so as to extend substantially in the vertical direction. In other words, the internal combustion engine 1 is a vertical internal combustion engine 1.

The upper part of the internal combustion engine 1 has a cooling fan 10 that is rotationally driven by the crankshaft 3. The cooling fan 10 includes a plurality of vanes 11 arranged in the circumferential direction.

As shown in FIGS. 2, 5, 6, and 7, the upper part of the internal combustion engine 1 has a fan cover 12 that covers the periphery of the cooling fan 10. The upper surface of the fan cover 12 is formed with an intake opening 13 for cooling air. The peripheral edge portion of the intake opening 13 is formed with a flat surface portion 14. The flat surface portion 14 has a recoil 20 mounted thereon. At three positions in the circumferential direction of the flat surface portion 14, fixing portions 15 are provided, and the recoil 20 is fixed to the fan cover 12 with bolts 16 fastened to the fixing portions 15.

The recoil 20 is provided with a recoil lever 21.

The recoil 20 includes a casing 22. The casing 22 is formed with a plurality of openings 23, and the openings 23 parts are provided with filters 24.

As shown in FIGS. 3, 4, and 8, the upper part of the internal combustion engine 1 is provided with a top cover 30 that covers the entire upper part of the internal combustion engine 1. The top cover 30 is for taking in the cooling air for cooling the internal combustion engine 1, and is formed with a cooling air passage through which the cooling air taken in from the top cover 30 reaches the fan cover 12.

The top cover 30 includes an upper surface 31 that is substantially flat and a side surface 32 that extends obliquely downward from the periphery of the upper surface 31.

The side surface 32 is arranged so that: it has a predetermined space from the outer periphery of the fan cover 12 in the front-rear direction of the side surface 32; and it has a smaller predetermined space from the outer periphery of the fan cover 12 at each side of the internal combustion engine 1 than in the front-rear direction. Further, between the lower end 42 of the top cover 30 and the lower end 44 of the fan cover 12, there is provided a cooling air intake gap 45 for taking in the cooling air 43 from the lower surface of the top cover 30.

The upper surface 31 of the top cover 30 is provided with a cooling air upper surface intake port 33 that is substantially annular. The side surface 32 is provided with a cooling air side surface intake port 34. The cooling air upper surface intake port 33, the cooling air side surface intake port 34, and the cooling air intake gap 45 constitute a cooling air intake portion according to the present invention.

The cooling air upper surface intake port 33 is composed of a large number of holes, and these holes are formed in a honeycomb shape. This reduces the opening width of each hole in the plurality of directions to make it difficult for dust to enter, and the dust and the like on the cooling air upper surface intake port 33 can be removed by hand. In addition, this can maintain the strength and opening area of the entire cooling air upper surface intake port 33.

The cooling air side surface intake port 34 is composed of a large number of holes, and these holes are formed in a substantially rectangular shape.

It is more likely that the dust on the cooling air upper surface intake port 33 enters through the hole due to the vibration generated during the work. Therefore, the cooling air upper surface intake port 33 is formed so that the opening areas of the holes of the cooling air upper surface intake port 33 is smaller than the opening areas of the holes of the cooling air side surface intake port 34.

The cooling air intake gap 45 is configured to take in the cooling air 43 from the lower surface of the top cover 30. Therefore, dust and the like adhering to the periphery of the cooling air intake gap 45 falls due to gravity, and blockage due to dust does not occurs. As a result, if the cooling air upper surface intake port 33 and the cooling air side surface intake port 34 are covered with dust or the like, the intake amount of cooling air can be sufficiently maintained.

As shown in FIGS. 5 and 6, the flat surface portion 14 of the fan cover 12 is formed with a first rib 40 facing the top cover 30. The first rib 40 is provided over substantially the entire circumference of the flat surface portion 14. The first rib 40 is provided on the outer peripheral side of the fixing portion 15 of the fan cover 12. A part of the first rib 40 slightly protrudes toward the outer periphery in order to receive the mounting portion of the recoil lever 21. Thus providing the first rib 40 facing the top cover 30 prevents the dust or the like from entering the intake opening 13 of the fan cover 12 unless the dust passing through the cooling air passage goes over the first rib 40. This can reduce the entering of the dust and the like passing through the cooling air passage. Further, the first rib 40 is formed upward facing the top cover 30. This causes the dust and the like, which has been prevented from entering by the first rib 40, to stay at the outer periphery of the first rib 40 by gravity and then to be discharged from the cooling air intake gap 45. Therefore, the dust and the like can be prevented from accumulating at the periphery of the cooling air upper surface intake port 33 and entering there together with the cooling air.

Further, as shown in FIG. 4, the back surface side of the top cover 30 is provided with a second rib 41 extending downward and arranged on an outer side of the first rib 40. In this embodiment, the second rib 41 is formed at a position corresponding to the front of the internal combustion engine 1 and a part of the rear of the internal combustion engine 1 except for the side surface 32. In other words, the second rib 41 is formed only in a position, away from the side surface 32, where the gap between the top cover 30 and the fan cover 12 is large.

Note that the second rib 41 may be formed over the entire circumference so as to correspond to the first rib 40. Further, the second rib 41 may be arranged inside the first rib 40.

As shown in FIG. 8, the second rib 41 is located on the outer peripheral side of the first rib 40, and the second rib 41 and the first rib 40 face each other substantially in the horizontal direction. The second rib 41 having a gap with the fan cover 12 below is thus arranged on the top cover 30, on the outer peripheral side of the first rib 40, so that the second rib 41 prevents the dust and the like from entering. This dust stays at the outer periphery of the first rib 40 by gravity. This makes entering of the dust more difficult.

In this embodiment, the horizontal gap between the first rib 40 and the second rib 41 is formed to have a smaller dimension than the width dimension of the hole of the cooling air side surface intake port 34. For example, when the width dimension of the hole of the cooling air side surface intake port 34 is about 5 mm, the gap between the first rib 40 and the second rib 41 is formed to be smaller than 5 mm.

The gap between the first rib 40 and the second rib 41 is formed to be narrower than the opening width of the cooling air side surface intake port 34 in this way, so that dust and the like can be prevented from entering through the gap between the first rib 40 and the second rib 41 if dust or the like enters through the cooling air intake gap 45.

The following describes the operation of this embodiment.

In this embodiment, driving the internal combustion engine 1 drives the crankshaft 3 to rotationally drive the cooling fan 10. The rotary drive of the cooling fan 10 takes in the cooling air from the cooling air intake gap 45 of the top cover 30, the cooling air upper surface intake port 33, and the cooling air side surface intake port 34.

The cooling air taken in from the cooling air upper surface intake port 33 at the position facing the intake opening 13 of the fan cover 12 is directly sent to the internal combustion engine 1 by the cooling fan 10 through the intake opening 13 of the fan cover 12. In this case, the cooling air upper surface intake port 33 is formed to have a small opening area, so that it can prevent dust and the like from entering.

On the other hand, the cooling air, which is taken in from the cooling air intake gap 45, the cooling air upper surface intake port 33 at a position not facing the intake opening 13 of the fan cover 12, and the cooling air side surface intake port 34, passes through the gap between the first rib 40 and the second rib 41, and is sent to the internal combustion engine 1 through the intake opening 13 of the fan cover 12.

In this case, the gap between the first rib 40 and the second rib 41 can form a labyrinth structure therein. This labyrinth structure can prevent dust and the like from entering when the cooling air passes through the gap between the first rib 40 and the second rib 41.

In the side surface 32 part of the top cover 30 where the second rib 41 is not provided, the side surface 32 and the first rib 40 are close to each other. This can add resistance to the flow of cooling air, and prevent dust and the like from entering. Further, since the second rib 41 is not provided, dust and the like that has stayed at the outer periphery of the first rib 40 do not get stuck between the second rib 41 and the fan cover 12. This easily discharges dust and the like from the cooling air intake gap 45 formed between the lower end 42 of the top cover 30 and the lower end 44 of the fan cover 12 to which the second rib 41 is not provided. At this time, it is preferable to set the width on the outer peripheral side of the first rib 40 to be narrower, in the flat surface portion 14 of the fan cover 12 facing the side surface 32 part of the top cover 30 where the second rib 41 is not provided.

As described above, in this embodiment, the internal combustion engine 1 includes: a fan cover 12 that covers the cooling fan 10 driven by the crankshaft 3; the top cover 30 that covers the fan cover 12; and a cooling air passage between the fan cover 12 and the top cover 30, and the fan cover 12 includes a first rib 40 facing the top cover 30 in the cooling air passage.

This can sufficiently maintain the intake amount of the cooling air, and prevent dust and the like from entering by the first rib 40 when the cooling air is taken in from the top cover 30 to the fan cover 12.

Further, in this embodiment, the top cover 30 includes a second rib 41 facing the first rib 40.

This can form a labyrinth structure in the gap between the first rib 40 and the second rib 41, and this labyrinth structure can prevent dust and the like from entering.

Further, in this embodiment, the top cover 30 includes a cooling air intake portion, and the cooling air intake portion has an upper surface 31 and a side surface 32 inclining downward from the upper surface 31, and the side surface 32 is provided with a cooling air side surface intake port.

With this configuration, the cooling air side surface intake port 34 allows the cooling air to be taken in from the side surface 32 of the top cover 30, and allows dust and the like that has been stirred up due to the work to be prevented from entering to sufficiently maintain the intake amount of cooling air.

Further, in this embodiment, the gap between the first rib 40 and the second rib 41 is formed to be narrower than the opening width of the cooling air side surface intake port 34 (side surface intake port).

With this configuration, forming the gap between the first rib 40 and the second rib 41 narrower than the opening width of the cooling air side surface intake port 34 can prevent dust and the like from entering through the gap between the first rib 40 and the second rib 41 even if dust or the like enters from the cooling air side surface intake port 34.

Further, in this embodiment, the second rib 41 is formed at a position away from the inclined side surface 32.

With this configuration, the second rib 41 is formed only in a position, away from the inclined side surface 32, where the gap between the top cover 30 and the fan cover 12 is large. This can form a labyrinth structure by the first rib 40 and the second rib 41, in the position away from the side surface 32 of the top cover 30, to prevent dust and the like from entering. At the same time, this can add resistance to the flow of cooling air by the side surface 32 and the first rib 40, in the vicinity of the side surface 32 of the top cover 30, to prevent dust and the like from entering.

Further, in this embodiment, the fan cover 12 has a fixing portion 15 for fixing the recoil 20 on the surface facing the top cover 30, and the first rib 40 is provided on the outer side of the fixing portion 15.

This can prevent dust and the like from entering the inside of the recoil 20 and the cooling fan 10 arranged on the downstream side of the recoil 20.

Further, in this embodiment, the crankshaft 3 is a vertical crankshaft that extends substantially in the vertical direction and is to be used for a working machine.

This can prevent dust and the like stirred up due to work from entering.

Further, in this embodiment, the working machine is a lawn mower having blades at the lower part.

This can prevent dust such as cut grass, which is stirred up due to lawn mowing work by the lawn mower, from entering.

The present invention is not limited to the configuration of the above embodiments, and can be implemented in various aspects without departing from the gist thereof.

[Configuration Supported by the Above Embodiment]

The above embodiment supports the following configurations.

(Configuration 1) An internal combustion engine, including: a fan cover that covers a cooling fan driven by a crankshaft; a top cover that covers the fan cover; and a cooling air passage between the fan cover and the top cover, wherein the fan cover includes a first rib facing the top cover in the cooling air passage.

This configuration can sufficiently maintain the intake amount of the cooling air, and can prevent dust and the like from entering by the first rib when the cooling air is taken in from the top cover to the fan cover.

(Configuration 2) The internal combustion engine according to configuration 1, wherein the top cover includes a second rib facing the first rib.

This configuration can form a labyrinth structure in the gap between the first rib and the second rib, and the labyrinth structure can prevent dust and the like from entering.

(Configuration 3) The internal combustion engine according to configuration 2, wherein the top cover includes a cooling air intake portion, the cooling air intake portion has an upper surface and a side surface inclining downward from the upper surface, and the side surface includes a cooling air side part intake port for taking in cooling air.

According to this configuration, the cooling air side part intake port allows the cooling air to be taken in from the side surface of the top cover, and allows dust and the like that has been stirred up due to the work to be prevented from entering to sufficiently maintain the intake amount of cooling air.

(Configuration 4) The internal combustion engine according to configuration 3, wherein a gap between the first rib and the second rib is formed to be narrower than an opening width of the cooling air side part intake port.

According to this configuration, forming the gap between the first rib and the second rib narrower than the opening width of the cooling air side part intake port can prevent dust and the like from entering through the gap between the first rib and the second rib even if dust or the like enter from the cooling air side part intake port.

(Configuration 5) The internal combustion engine according to configuration 3, wherein the second rib is formed at a position away from the inclining side surface.

According to this configuration, the second rib is formed only in a position, away from the inclined side surface, where the gap between the top cover and the fan cover is large. This allows the first rib and the second rib to form a labyrinth structure to prevent dust and the like from entering, in a position away from the side surface of the top cover. At the same time, this allows the side surface and the first rib to add resistance to the flow of cooling air to prevent dust and the like from entering, in the vicinity of the side surface of the top cover.

(Configuration 6) The internal combustion engine according to any one of configurations 1 to 5, wherein the fan cover has a fixing portion for fixing a recoil on a surface facing the top cover, and the first rib is provided on an outer side of the fixing portion.

This configuration can prevent dust and the like from entering the inside of the recoil and the cooling fan arranged on the downstream side of the recoil.

(Configuration 7) The internal combustion engine according to any one of configurations 1 to 6, wherein the crankshaft is a vertical crankshaft that extends substantially in the vertical direction and is to be used for a working machine.

This configuration can prevent dust and the like stirred up due to the work from entering.

(Configuration 8) The internal combustion engine according to configuration 7, wherein the working machine is a lawn mower having a blade at a lower part.

This configuration can prevent dust such as cut grass, which is stirred up due to the lawn mowing work by the lawn mower, from entering.

REFERENCE SIGNS LIST

1 internal combustion engine
2 cylinder head
3 crankshaft
10 cooling fan
12 fan cover
13 intake opening
14 flat surface portion
15 fixing portion
20 recoil
21 recoil lever
30 top cover
31 upper surface
32 side surface
33 cooling air upper surface intake port
34 cooling air side surface intake port
40 first rib
41 second rib

What is claimed is:

1. An internal combustion engine, comprising:

a fan cover that covers a cooling fan driven by a crankshaft;

a top cover that covers the fan cover; and a cooling air passage between the fan cover and the top cover, wherein the top cover includes an upper surface that is substantially flat and a side surface that extends obliquely downward from a periphery of the upper surface, the side surface is provided with a cooling air side surface intake port, the cooling air side surface intake port includes a plurality of holes that take in cooling air, the fan cover includes a first rib facing the top cover in the cooling air passage, the fan cover is formed with an inlet opening for taking in the cooling air, the first rib is provided over substantially the entire circumference of the inlet opening at a peripheral edge of the inlet opening, a back surface side of the top cover is provided with a second rib extending downward in a vertical direction of the internal combustion engine, and the second rib and the first rib face each other in a horizontal direction of the internal combustion engine.

2. The internal combustion engine according to claim 1, wherein a gap between the first rib and the second rib is formed to be narrower than an opening width of the cooling air side surface intake port.

3. The internal combustion engine according to claim 1, wherein the second rib is formed at a position away from the side surface.

4. The internal combustion engine according to claim 1, wherein the fan cover has a fixing portion for fixing a recoil on a surface facing the top cover, and the first rib is provided on an outer side of the fixing portion.

5. The internal combustion engine according to claim 1, wherein the crankshaft is a vertical crankshaft that extends substantially in the vertical direction and is to be used for a working machine.

6. The internal combustion engine according to claim 5, wherein the working machine is a lawn mower having a blade at a lower part.

7. The internal combustion engine according to claim 1, wherein the second rib is arranged on an outer side of the first rib.

8. The internal combustion engine according to claim 1, wherein the first rib and the second rib overlap each other in the vertical direction.

* * * * *